US010104976B1

(12) United States Patent
Sprague

(10) Patent No.: US 10,104,976 B1
(45) Date of Patent: Oct. 23, 2018

(54) KNEELER

(71) Applicant: Frederick Sprague, Baileyville, ME (US)

(72) Inventor: Frederick Sprague, Baileyville, ME (US)

( * ) Notice: Subject to any disclaimer, the term of this patent is extended or adjusted under 35 U.S.C. 154(b) by 0 days.

(21) Appl. No.: 15/946,263

(22) Filed: Apr. 5, 2018

(51) Int. Cl.
*A47C 16/04* (2006.01)

(52) U.S. Cl.
CPC ..... *A47C 16/04* (2013.01)

(58) Field of Classification Search
CPC ..... A47C 16/04
See application file for complete search history.

(56) References Cited

U.S. PATENT DOCUMENTS

| | | | | | |
|---|---|---|---|---|---|
| 830,103 | A * | 9/1906 | Rundell | A47C 16/04 | 182/230 |
| 1,408,253 | A * | 2/1922 | Blank | A47C 16/04 | 182/129 |
| 1,712,863 | A * | 5/1929 | Wickstrum | A47C 16/04 | 297/187 |
| 2,225,696 | A | 12/1940 | Holzderber | | |
| 2,318,059 | A * | 5/1943 | Cooper | A47C 16/04 | 280/32.5 |
| 2,480,406 | A * | 8/1949 | Forney | A41D 13/065 | 182/230 |
| 2,829,705 | A | 4/1958 | Godshalk et al. | | |
| 4,394,049 | A | 7/1983 | Ward | | |
| D287,074 | S | 12/1986 | Ritchie | | |
| 4,798,264 | A | 1/1989 | Miller et al. | | |
| 4,850,069 | A * | 7/1989 | Harper | A47C 16/04 | 182/129 |
| D311,282 | S | 10/1990 | Tooley | | |
| 5,380,021 | A | 1/1995 | Doherty | | |
| 6,302,413 | B1 * | 10/2001 | Comeaux | A47C 9/027 | 280/32.5 |
| 8,479,335 | B1 | 7/2013 | Perry | | |
| 9,420,893 | B1 | 8/2016 | Clark | | |
| D775,842 | S | 1/2017 | Clark | | |
| 9,681,756 | B2 | 6/2017 | Smith | | |
| 2002/0014796 | A1 * | 2/2002 | Bottoms | A47C 9/025 | 297/423.11 |
| 2004/0201268 | A1 | 10/2004 | Liao | | |
| 2004/0262869 | A1 * | 12/2004 | Reining | A47C 9/027 | 280/79.11 |
| 2007/0205054 | A1 * | 9/2007 | Gentles | A47C 16/04 | 182/230 |
| 2008/0222789 | A1 * | 9/2008 | Pfeiffer | A47C 16/04 | 4/571.1 |
| 2013/0192928 | A1 * | 8/2013 | Lamos | A01B 75/00 | 182/230 |
| 2015/0250321 | A1 * | 9/2015 | Perry | A47C 16/04 | 297/423.11 |

* cited by examiner

*Primary Examiner* — Philip F Gabler
(74) *Attorney, Agent, or Firm* — Anthony D. Pellegrini

(57) ABSTRACT

A kneeler to support a person in the kneeling position, having a frame configured to support a pair of flexible knee support pouches, each knee support pouch configured to retain and support a human knee above the ground, and further having a pair of laterally disposed handles to assist the person with moving into and out of a kneeling position.

29 Claims, 13 Drawing Sheets

KNEELER

BACKGROUND OF THE INVENTION

1. Technical Field

The present invention relates generally to personal assistance devices. More particularly, the present invention relates to a kneeler configured to support a person in a kneeling position above a floor or the ground while providing a comfortable interface for the person's knees, and further providing laterally disposed handles to assist the person with moving into a kneeling position from a standing position and moving into a standing position from a kneeling position.

2. Description of Prior Art

Kneelers are well known in the art. They have been used to provide support to persons who wish to perform tasks while in a kneeling position, such as gardening, bathing children or pets, praying, cleaning floors, creating floor-based artwork, and other tasks. The primary function of a kneeler is to provide an interface between the person's knees and the floor or ground, whereby the interface protects the knees from discomfort or injury arising from prolonged contact with a hard surface. A secondary function of a kneeler is to provide a means for assisting the person in moving into the kneeling position from a standing position and in moving to a standing position from the kneeling position.

An early example of a kneeler is disclosed in U.S. Pat. No. 2,225,696, to Holzderber. This "kneeling stool" provides a wooden frame with upwardly extending vertically oriented side panels and a horizontal kneeling platform located between and connected to the side panels. Placed on the top surface of the horizontal kneeling platform is a cushion. The user uses the device by kneeling onto the horizontal kneeling platform, and may use the side panels to assist with moving into and out of the kneeling position.

A more recent example of a kneeler is disclosed in U.S. Pat. No. 9,420,893, to Clark. This kneeler provides a pair of tubular inverted U-shaped handles extending upwardly from a horizontal kneeling platform located between and connected to the handles. Placed on the top surface of the horizontal kneeling platform is a cushion. The handles are removably attached to the horizontal kneeling platform in a manner that allows disassembly of the device without the use of tools. The user uses the device by kneeling onto the horizontal kneeling platform, and may use the side handles to assist with moving into and out of the kneeling position.

The kneeler disclosed in U.S. Pat. No. 8,479,335, to Perry, is similar to the Clark kneeler in construct, having a pair of tubular inverted U-shaped handles extending upwardly from a horizontal lower frame located between and connected to the handles. A horizontal kneeling platform with a pair of small cushions attached to its top surface is suspended from the side handles above the lower frame by a series of elasticized members. The user uses the device by kneeling onto the horizontal kneeling platform, which then slowly moves towards the lower frame as the elasticized members are stretched out by the weight of the user. When the user wishes to stand, the elasticized members assist with lifting the user, who may also use the side handles to assist with moving into the standing position.

Other kneelers are similarly constructed, with lateral handles and a horizontal kneeling platform. In addition, U.S. Pat. Appl. No. 2004/0201268, to Liao, and U.S. Des. Pat. No. D311,282, to Tooley, both disclose kneelers which can be inverted, so that the surface of the horizontal kneeling platform that faces the floor or ground when the device is used for kneeling becomes a seat when the device is inverted. These may have tubular sides, or sides created from wooden or plastic panels, and the horizontal kneeling platform may be cushioned on one or both sides. Other kneelers having some combination of lateral sides and a horizontal kneeling platform are also known, including U.S. Pat. No. 4,798,264, to Miller (the horizontal platform contains a pair of padded concavities to receive a person's knees); U.S. Des. Pat. No. D287,074, to Ritchie (having a pair of tubular inverted J-shaped handles); U.S. Pat. No. 4,394,049, to Ward (side handles are of differing heights); and U.S. Pat. No. 2,829,705, to Godshalk, et al. (handles fold onto horizontal kneeling platform for storage).

While each of the foregoing devices differs from the others in certain aspects, they all share the commonality of having an inferior interface between the user's knees and the device. That is, each device employs a rigid horizontal kneeling platform onto which the user kneels. Though a cushion may be interposed between the knees and the platform, the point of contact of each knee remains relatively small, so that nearly the entirety of the user's weight is concentrated onto small portions of the front of the knees. For many this does not present any problem, and thus the common design embodied in the prior art is sufficient, at least for short term use. But persons who have sensitivity in their knees, because of joint disease, or congenital defects, or other reasons, may find that the concentrated point of contact is uncomfortable or even painful. This is especially so for persons who have had knee replacement surgery and thus have metal components in their knees. Placing their full weight on the front of their knees can result in severe pain as the internal metal components press against bone and tissue. Even those who have no issues with their knees can experience discomfort after prolonged kneeling on a rigid platform, even if there is a cushion.

There is thus demonstrated the need for a kneeler which provides for a superior interface between the user's knees and the device, namely, an interface which distributes the user's weight over a relatively larger area, thereby minimizing or even eliminating discomfort while kneeling.

It is therefore an object of the present invention to present a kneeler which comfortably supports a person in the kneeling position by providing for an interface between the person's knees and the device which distributes the user's weight over a relatively large area.

It is a further object of the present invention to present a kneeler which has handles for assisting a person with moving into a kneeling position and moving into a standing position.

It is yet a further object of the present invention to present a kneeler which may be inverted so as to be used as a bench.

It is yet a further object of the present invention to present a kneeler which may be folded or collapsed for easy storage.

It is yet a further object of the present invention to present a kneeler which may be adjusted to accommodate persons of varying heights.

Other objects of the present invention will be readily apparent from the description that follows.

SUMMARY OF THE INVENTION

The present invention discloses a kneeler which provides for a superior interface between the user's knees and the device. The interface is a pair of elasticized knee support pouches which both cradle the knees and suspend them over the ground or floor. Because the knees never come in contact with any hard surface, and because the user's weight is distributed over the relatively large area of the knee support pouches, discomfort while kneeling is minimized or even eliminated. This becomes even more pronounced when a user shifts position, and thereby shifts the weight from one knee to the other. The elasticity of the knee support pouches automatically causes them to adjust to the new position by one knee support pouch stretching a bit more and the other stretching a bit less. Prior art kneelers, using cushions attached to rigid kneeling platforms, cannot so accommodate such positional shifts.

The elasticized knee support pouches are suspended from a frame. The frame may have any basic structure that supports the pair of knee support pouches, preferably comprising a pair of lateral sides, a central support member located between the sides, and an integration member connecting the sides and central support member into a rigid frame. Embodiments include frames constructed of tubular members, of planar members, being height adjustable, being collapsible, etc. Incorporated into the lateral sides of the frame may be handles which provide assistance in moving into and out of the kneeling position when using the device. Additional optional features may also be used, such as wide foot pads attached to the bottom of the legs of frame for those embodiments of the device having legs, to better allow the device to be used for gardening without sinking into the soil. Also, casters can be placed onto the bottom of the legs of the frame, to permit the device to be rolled along a smooth surface, such as a floor.

The kneeler of the present invention is intended to be light weight, so that it can be easily transported to the desired location for use and readily repositioned as needed (for example, while gardening or cleaning a floor). In some embodiments, the device may also be inverted and used as a bench.

Because of the pliable, stretchy nature of the knee pouches, their use lessens pressure on the user's knees and disperses the user's weight around the joints. The kneeler of the present invention better disperses the pressure in the knees for those who have had reconstructed or replacement knee surgeries. Because of the higher relative height of the knee pouches, the distance the user needs to descend and ascend when using the kneeler is lessened compared with other devices, where one has to descend and ascend all the way to and from the floor (ground). Because of the height and flexibility of the kneel pouches, kneeling and standing is virtually effortless. People with failing health who otherwise have difficulty descending to the kneeling position on the floor can use the kneeler of the present invention to kneel without going to the full depth of the floor. Instead of bending over at the waist, the kneeler presents the user with an option for better body mechanics. The design of the kneeler helps descending and ascending motions. People with failing health or post surgery thus can live more productive and full lives.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 1:
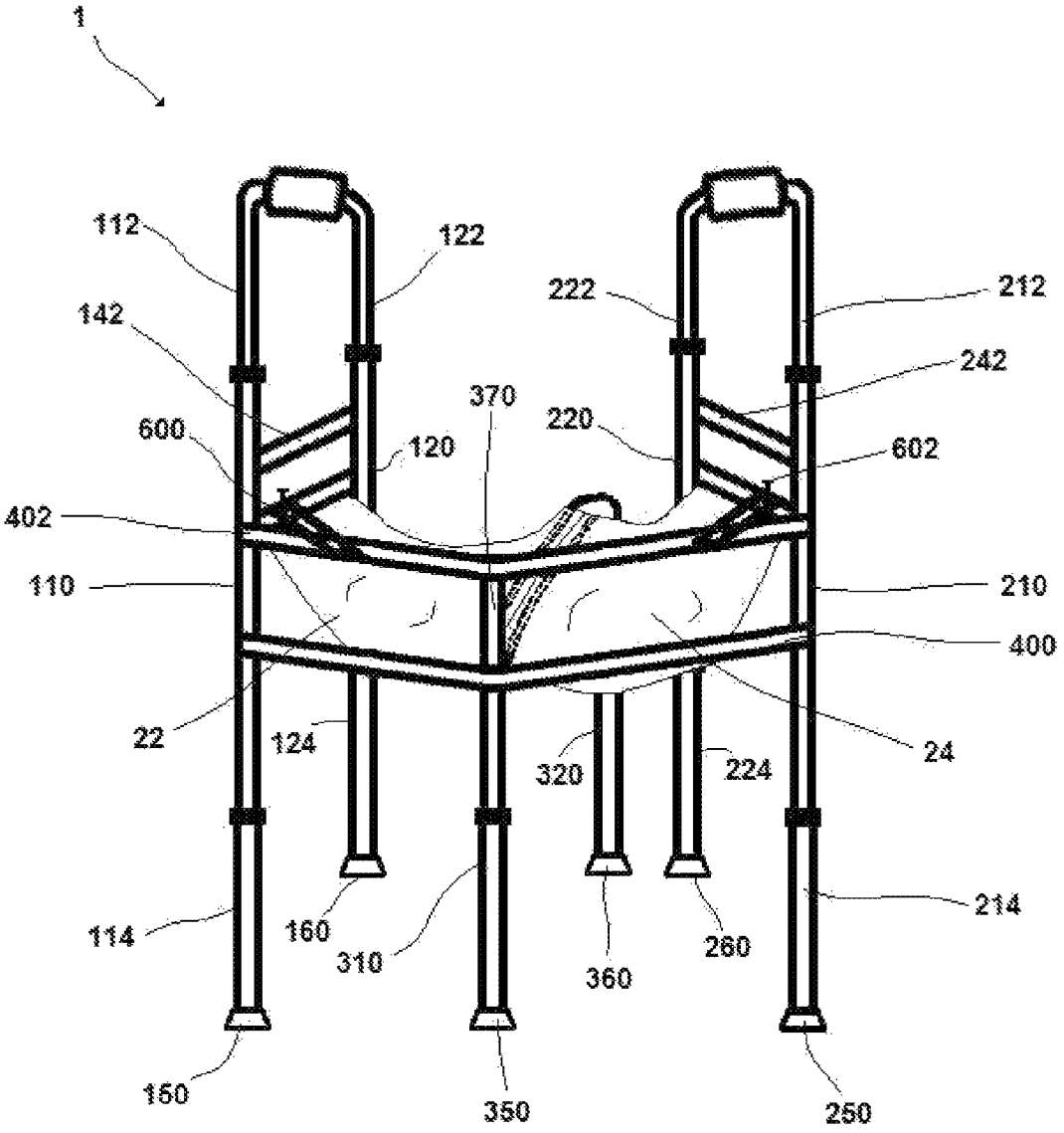
FIG. 1 is a front perspective view of one embodiment of the device claimed herein.
Figure 2A:
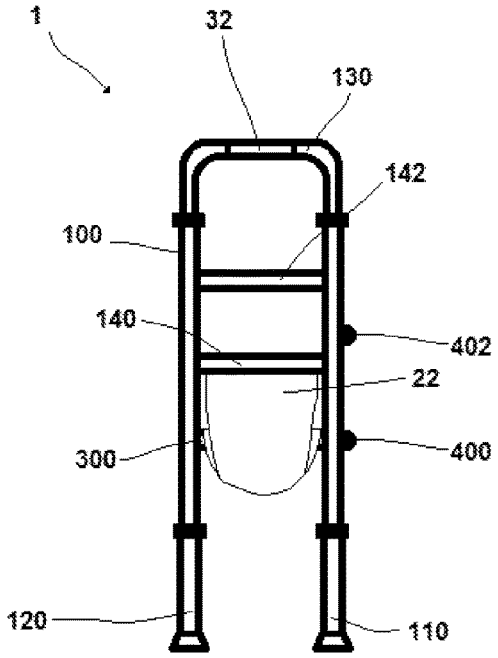
FIG. 2A is a right side plan view of the embodiment of the device depicted in FIG. 1.
Figure 2B:
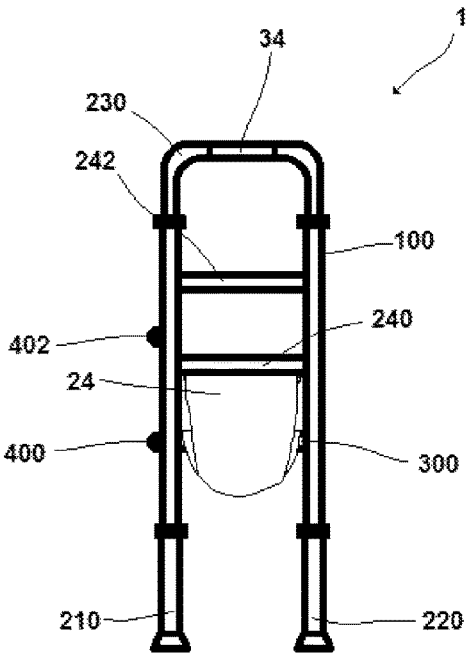
FIG. 2B is a left side plan view of the embodiment of the device depicted in FIG. 1.

The present invention is a kneeler 1 for use by a human, said kneeler 1 comprising a frame 10, a first knee support pouch 22, and a second knee support pouch 24. The frame 10 is substantially rigid and is configured to support the first knee support pouch 22 and the second knee support pouch 24 above a surface 5, such as the ground or the floor. When used, the first knee support pouch 22 and the second knee support pouch 24 remain at least a small distance above the surface 5.

The frame 10 is comprised of a first lateral support member 100, a second lateral support member 200, a central support member 300, and an integration support member 400. Each of these components is rigid. The first lateral support member 100 is spaced apart from the second lateral support member 200. The central support member 300 is spaced apart from the first lateral support member 100 and from the second lateral support member 200 and is located between the first lateral support member 100 and the second lateral support member 200. The integration support member 400 is attached to the first lateral support member 100, the second lateral support member 200, and the central support member 300, so that all four of these components create one substantially rigid frame 10. The first knee support pouch 22 is located between and attached to the first lateral support member 100 of the frame 10 and the central support member 300 of the frame 10. The second knee support pouch 24 is located between and attached to the second lateral support member 200 of the frame 10 and the central support member 300 of the frame 10. The four components of the frame 10 may be configured in many different ways, and may be made of many different materials, examples of which are provided, below.

Figure 4A:
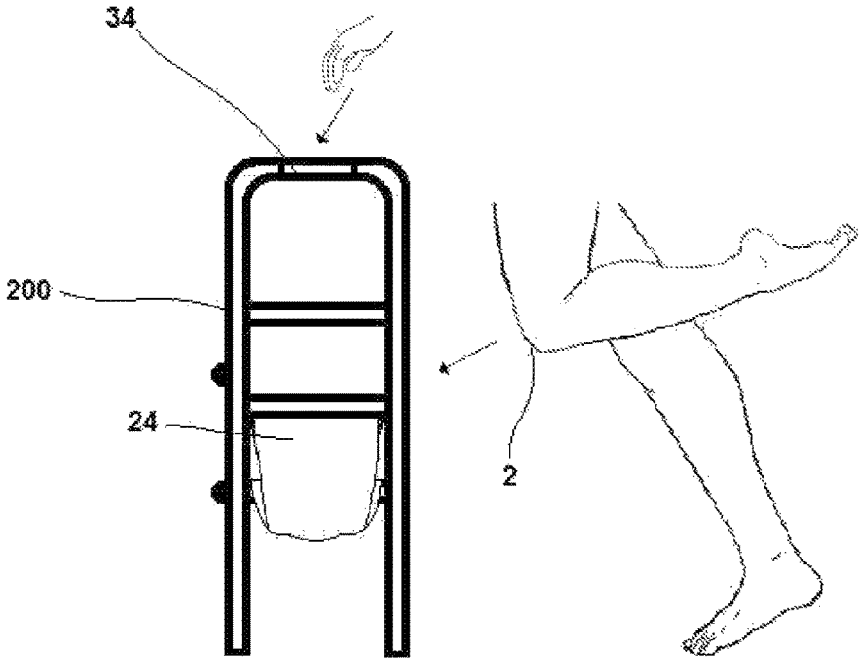
FIG. 4A is a left side plan view of one embodiment of the device claimed herein, showing a person preparing to use the device. The user is directing one hand toward a handle and directing a knee into one of the knee support pouches.
Figure 4B:
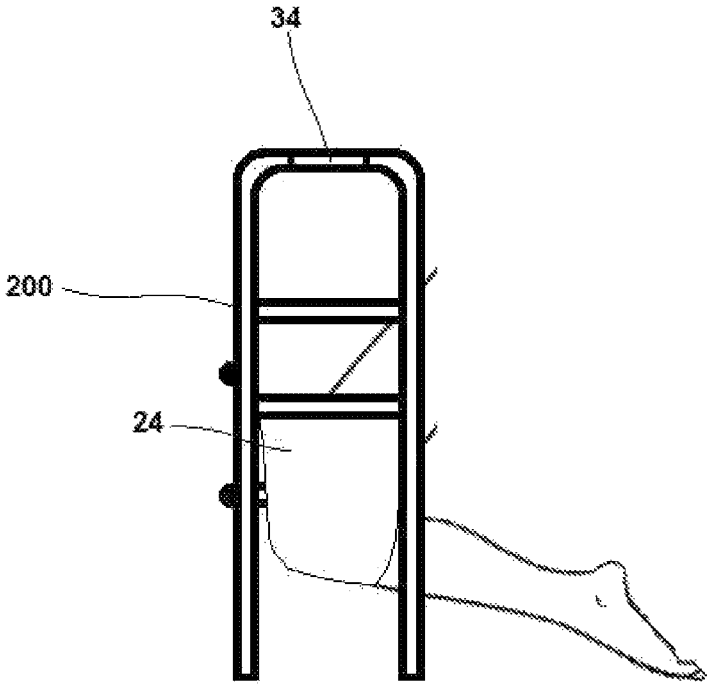
FIG. 4B is a left side plan view of the embodiment of the device shown in FIG. 4A, wherein the person has successfully placed a knee into one of the knee support pouches. The knee support pouch is seen to be stretched by the weight of the person and to snugly surround the front and sides of the knee.
Figure 5A:
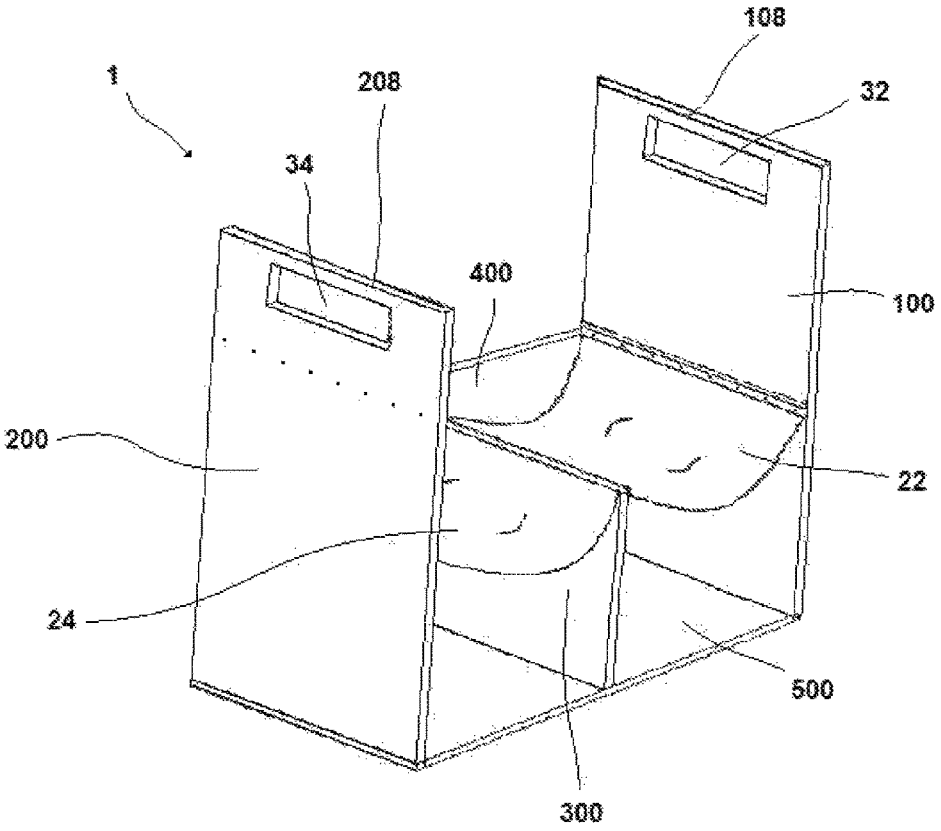
FIG. 5A is a left-rear perspective view of another embodiment of the device claimed herein, wherein the frame is made of planar members.
Figure 5B:
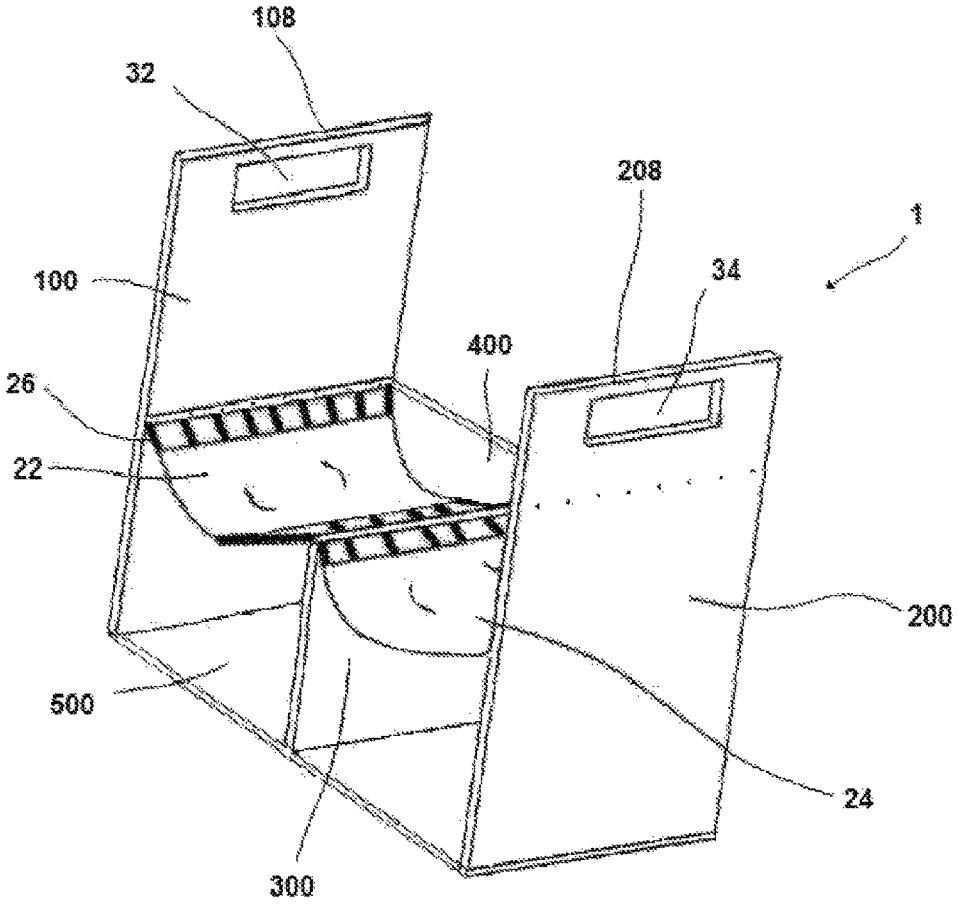
FIG. 5B is a right-rear perspective view of yet another embodiment of the device claimed herein, wherein the frame is made of planar members and the knee support pouches are suspended from the frame using elasticized support members.
Figure 5C:
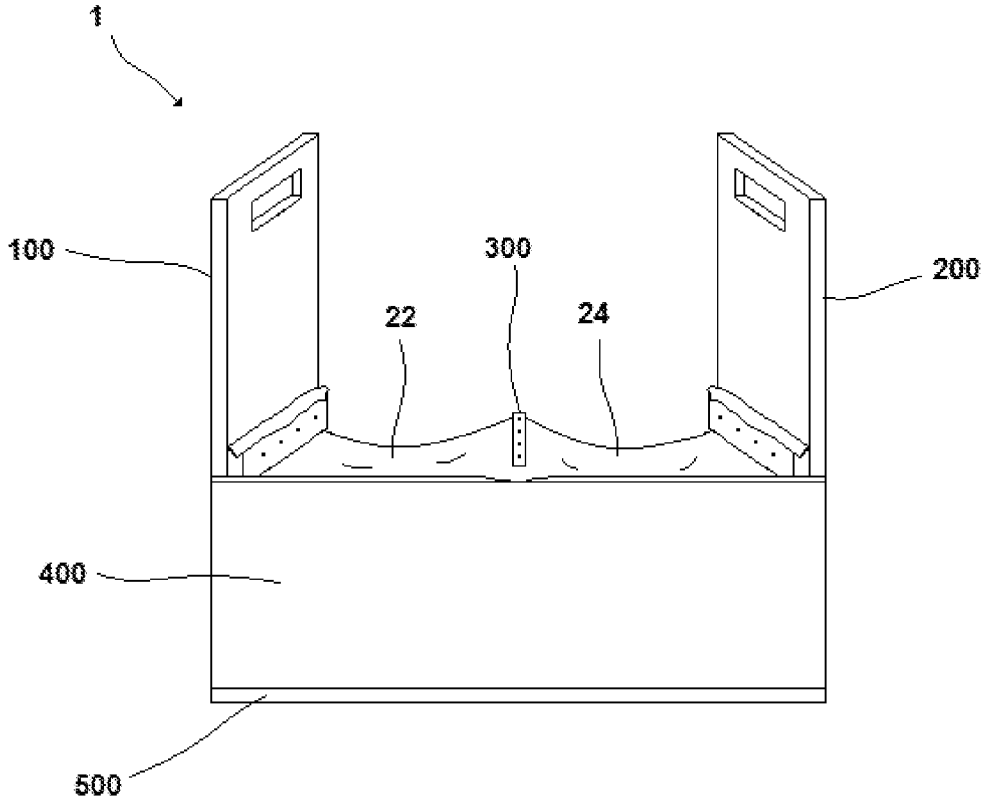
FIG. 5C is a front perspective view of the embodiment of the device depicted in FIG. 5A.
Figure 5D:
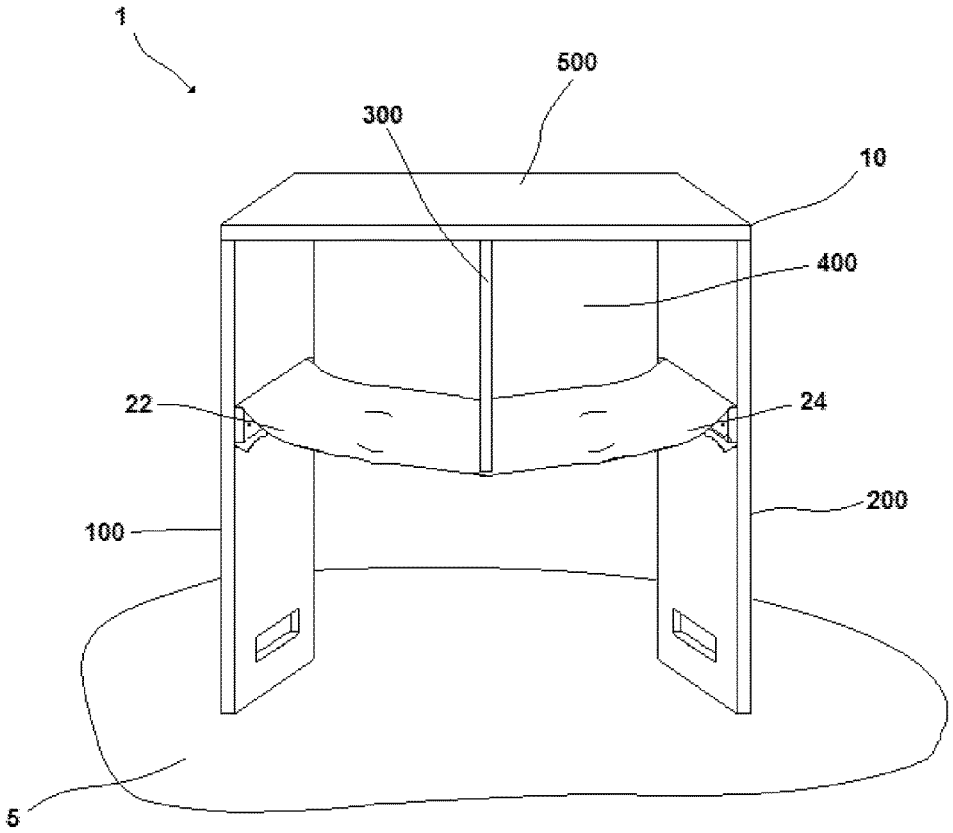
FIG. 5D is a rear perspective view of the embodiment of the device depicted in FIG. 5A, which has been inverted and placed on the ground so that the base panel may be used as a seating surface.

Optionally, the kneeler 1 may further comprise a first handle 32 and a second handle 34. The first handle 32 is located on the first lateral support member 100 of the frame 10 and the second handle 34 is located on the second lateral support member 200 of the frame 10. The first and second handles 32,34 are used to assist the person using the kneeler 1 to move into and out of a kneeling position. See FIGS. 4A and 4B. The first and second handles 32,34 may also be used to move the kneeler 1.

In one embodiment of the kneeler 1, the first lateral support member 100 of the frame 10 is formed of a tubular member shaped into an inverted U. The first lateral support member 100 has a substantially vertically oriented front leg 110, a substantially vertically oriented rear leg 120, a substantially horizontally oriented top portion 130 connecting the front leg 110 to the rear leg 120, a substantially horizontally oriented cross member 140 connecting the front leg 110 to the rear leg 120 and located below the top portion 130, a front foot 150 located at the bottom of the front leg 110, and a rear foot 160 located at the bottom of the rear leg 120. The first lateral support member 100 is oriented substantially vertically and perpendicular to the surface 5 onto which the kneeler 1 is placed when in use. Similarly, the second lateral support member 200 of the frame 10 is formed of a tubular member shaped into an inverted U. The second lateral support member 200 has a substantially vertically oriented front leg 210, a substantially vertically oriented rear leg 220, a substantially horizontally oriented top portion 230 connecting the front leg 210 to the rear leg 220, a substantially horizontally oriented cross member 240 connecting the front leg 210 to the rear leg 220 and located below the top portion 230, a front foot 250 located at the bottom of the front leg 210, and a rear foot 260 located at the bottom of the rear leg 220. The second lateral support member 200 is oriented substantially vertically and perpendicular to the surface 5, and substantially parallel to the first lateral support member 100. The second lateral support member 200 may be dimensioned and sized substantially the same as the first lateral support member 100. In the same manner, the central support member 300 of the frame 10 is formed of a tubular member shaped into an inverted U. It has a substantially vertically oriented front leg 310, a substantially vertically oriented rear leg 320, a substantially horizontally oriented top portion 330 connecting the front leg 310 to the rear leg 320, a front foot 350 located at the bottom of the front leg 310, and a rear foot 360 located at the bottom of the rear leg 320. The central support member 300 is oriented substantially vertically and perpendicular to the surface 5 and substantially parallel to the first lateral support member 100 and the second lateral support member 200. The central support member 300 has a height that is lower than the heights of the first lateral support member 100 and the second lateral support member 200. Finally, the integration support member 400 is formed of a tubular member. Alternately, the integration support member 400 is formed of an elongate flat bar. It is oriented substantially horizontally and attached to the front leg 110 of the first lateral support member 100, to the front leg 210 of the second lateral support member 200, and to the front leg 310 of the central support member 300. See FIGS. 1, 2A, 2B, 6A, and 6B. Each of the first lateral support member 100, the second lateral support member 200, the central support member 300, and the integration support member 400 may be made of plastic, metal, or a composite material. All of the components may be made of the same material, or different materials may be used for different components. In the preferred embodiment, all of the components are made of aluminum.

In this embodiment, the first knee support pouch 22 attaches to the cross member 140 of the first lateral support member 100 of the frame 10 and to the top portion 330 of the central support member 300, and the second knee support pouch 24 attaches to the cross member 240 of the second lateral support member 200 and to the top portion 330 of the central support member 300.

In a variant of this embodiment, the first lateral support member 100 may further comprise one or more supplementary cross members 142. Each of the supplementary cross members 142 of the first lateral support member 100 is formed of a tubular member and is oriented substantially horizontally and connects the front leg 110 of the first lateral support member 100 to the rear leg 120 of the first lateral support member 100. Similarly, the second lateral support member 200 may further comprise one or more supplementary cross members 242. Each of the supplementary cross members 242 of the second lateral support member 200 is formed of a tubular member and is oriented substantially horizontally and connects the front leg 210 of the second lateral support member 200 to the rear leg 220 of the second lateral support member 200. The use of the supplementary cross members 142,242 adds rigidity to the frame 10. The supplementary cross members 142,242 may be made of plastic, metal, or a composite material. All of the supplementary cross members 142,242 may be made of the same material, or different materials may be used for different supplementary cross members 142,242. In the preferred embodiment, all of the supplementary cross members 142, 242 are made of aluminum.

In another variant of this embodiment, the frame 10 further comprises one or more supplementary integration support members 402. Each of the supplementary integration support members 402 is formed of a tubular member or alternatively a flat elongate bar and is oriented substantially horizontally and is attached to the front leg 110 of the first lateral support member 100 and to the front leg 210 of the second lateral support member 200. Optionally, one or more of the supplementary integration support members 402 may also be attached to the front leg 310 of the central support member 300.

In yet another variant of this embodiment, the central support member 300 further comprises an extension member 370. See FIG. 1. The extension member 370 extends upwardly from the front leg 310 of the central support member 300 of the frame 10. In this variant, the frame 10 also comprises one or more supplementary integration support members 402, as described above. At least one of the supplementary integration support members 402 is attached to the extension member 370 of the central support member 300. See FIG. 1.

In yet another variant of this embodiment, the front leg 110 of the first lateral support member 100 of the frame 10 has a telescoping lower portion 114 which is configured to allow the front leg 110 of the first lateral support member 100 to be lengthened or shortened. The rear leg 120 of the first lateral support member 100 has a telescoping lower portion 124 which is configured to allow the rear leg 120 of the first lateral support member 100 to be lengthened or shortened. The front leg 210 of the second lateral support member 200 has a telescoping lower portion 214 which is configured to allow the front leg 210 of the second lateral support member 200 to be lengthened or shortened. The rear leg 220 of the second lateral support member 200 has a telescoping lower portion 224 which is configured to allow the rear leg 220 of the second lateral support member 200 to be lengthened or shortened. The front leg 310 of the central support member 300 has a telescoping lower portion which is configured to allow the front leg 310 of the central support member 300 to be lengthened or shortened. The rear leg 320 of the central support member 300 has a telescoping lower portion which is configured to allow the rear leg 320 of the central support member 300 to be lengthened or shortened. In each of these legs, the telescoping lower portion fits into the adjacent portion of the leg, and then locks in place using any method known in the art. Alternatively, the adjacent portions of the legs fit into the lower telescoping portions of the legs.

In yet another variant of this embodiment, the front leg 110 of the first lateral support member 100 of the frame 10 has a telescoping upper portion 112 which is configured to allow the front leg 110 of the first lateral support member 100 to be lengthened or shortened. The rear leg 120 of the first lateral support member 100 has a telescoping upper portion 122 which is configured to allow the rear leg 120 of the first lateral support member 100 to be lengthened or shortened. The front leg 210 of the second lateral support member 200 has a telescoping upper portion 212 which is configured to allow the front leg 210 of the second lateral support member 200 to be lengthened or shortened. The rear leg 220 of the second lateral support member 200 has a telescoping upper portion 222 which is configured to allow the rear leg 220 of the second lateral support member 200 to be lengthened or shortened. In each of these legs, the telescoping upper portion fits into the adjacent portion of the leg, and then locks in place using any method known in the art. Alternatively, the adjacent portions of the legs fit into the upper telescoping portions of the legs.

In yet another variant of this embodiment, the front leg 310 of the central support member 300 of the frame 10 has a telescoping upper portion 312 which is configured to allow the front leg 310 of the central support member 300 to be lengthened or shortened. The rear leg 320 of the central support member 300 has a telescoping upper portion 322 which is configured to allow the rear leg 320 of the central support member 300 to be lengthened or shortened. In each of these legs, the telescoping upper portion fits into the adjacent portion of the leg, and then locks in place using any method known in the art. Alternatively, the adjacent portions of the legs fit into the upper telescoping portions of the legs. By raising or lowering the upper portions 312,322 of the front and back legs 310,320 of the central support member 300, a user of the device can alter the height of the first and second knee support pouches 22,24 without necessarily changing the height of the frame 10. This allows the device 1 to accommodate persons of different weights, whereby a heavier person will tend to distend the first and second knee support pouches 22,24 to a greater extent when using the device, and therefore would require greater clearance under the first and second knee support pouches 22,24 to avoid contact with the ground 5.

In yet another variant of this embodiment, the kneeler 1 has a first handle 32 attached to the top portion 130 of the first lateral support member 100, and a second handle 34 attached to the top portion 230 of the second lateral support member 200. The first and second handles 32, 34 may be made of a cushioning material, such as closed cell foam, or from plastic or other material.

In yet another variant of this embodiment, the frame 10 further comprises a plurality of pivot members 600 connecting the first lateral support member 100 to the integration support member 400, the second lateral support member 200 to the integration support member 400, and the central support member 300 to the integration support member 400. Use of the pivot members 600 allows the frame 10 to be folded. Associated with each pivot member 600 may be a locking mechanism 602. Each locking mechanism 602 is configured to have a locked state and an unlocked state, whereby when the locking mechanism 602 is in the locked state the pivot member 600 associated with it is prevented from moving, and when the locking mechanism 602 is in the unlocked state the pivot member 600 associated with it is free to move.

In one variant, each of the pivot members 600 may be a hinge. The locking member 602 may be a pin that inserts into the pivot member 600.

In another variant, each of the pivot members 600 may be a pivot pin. One pivot pin passes through the integration support member 400 and the central support member 300, while other pivot pins pass through the integration support member 400 and either the first lateral support member 100 or the second lateral support member, as the case may be. See FIG. 6A. The locking member 602*a* may be a removable cross member that attaches at one end to the integration support member 400 and at the other end to either the first lateral support member 100 or the second lateral support member, as the case may be. See FIG. 6A. Where a supplemental integration support member 402 is used, still other pivot pins pass through the supplemental integration support member 400 and one of the central support member 300, the first lateral support member 100, or the second lateral support member, as the case may be. See FIG. 6A. In order to fold the device 1, at least one end of each locking member 602*a* is detached; then, the first and second lateral support members 100,200 are moved vertically and opposite with regard to each other. The integration support member 400 pivots about the pivot pins in a diagonal motion, bringing the first and second lateral support members 100, 200 together. That is, movement of the first lateral support member 100 downward relative to the second lateral support member 200 results in the first and second lateral support members 100,200 being brought closer together. See FIG. 6B.

Figure 6A:
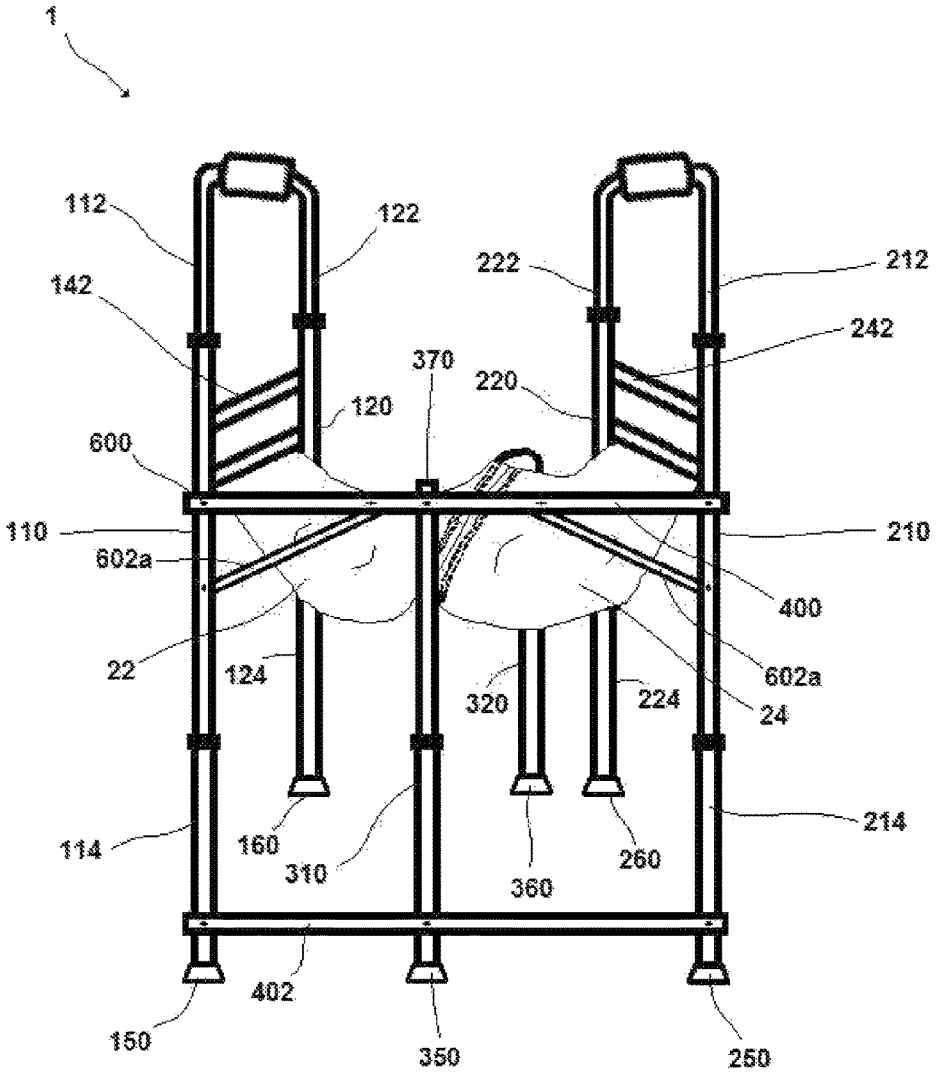
FIG. 6A is a front perspective view of another embodiment of the device claimed herein.
Figure 6B:
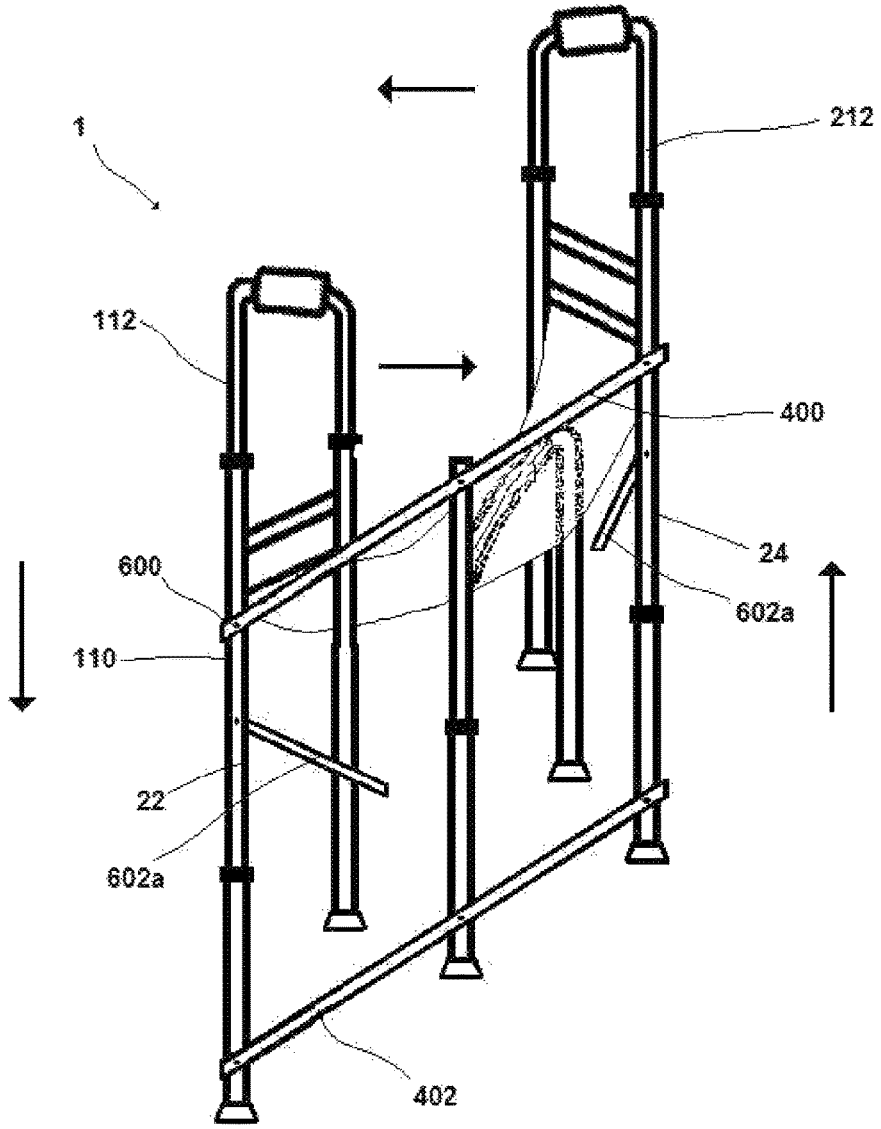
FIG. 6B is a front perspective view of the embodiment of the device depicted in FIG. 6A which is shown in the process of being folded.
Figure 6C:
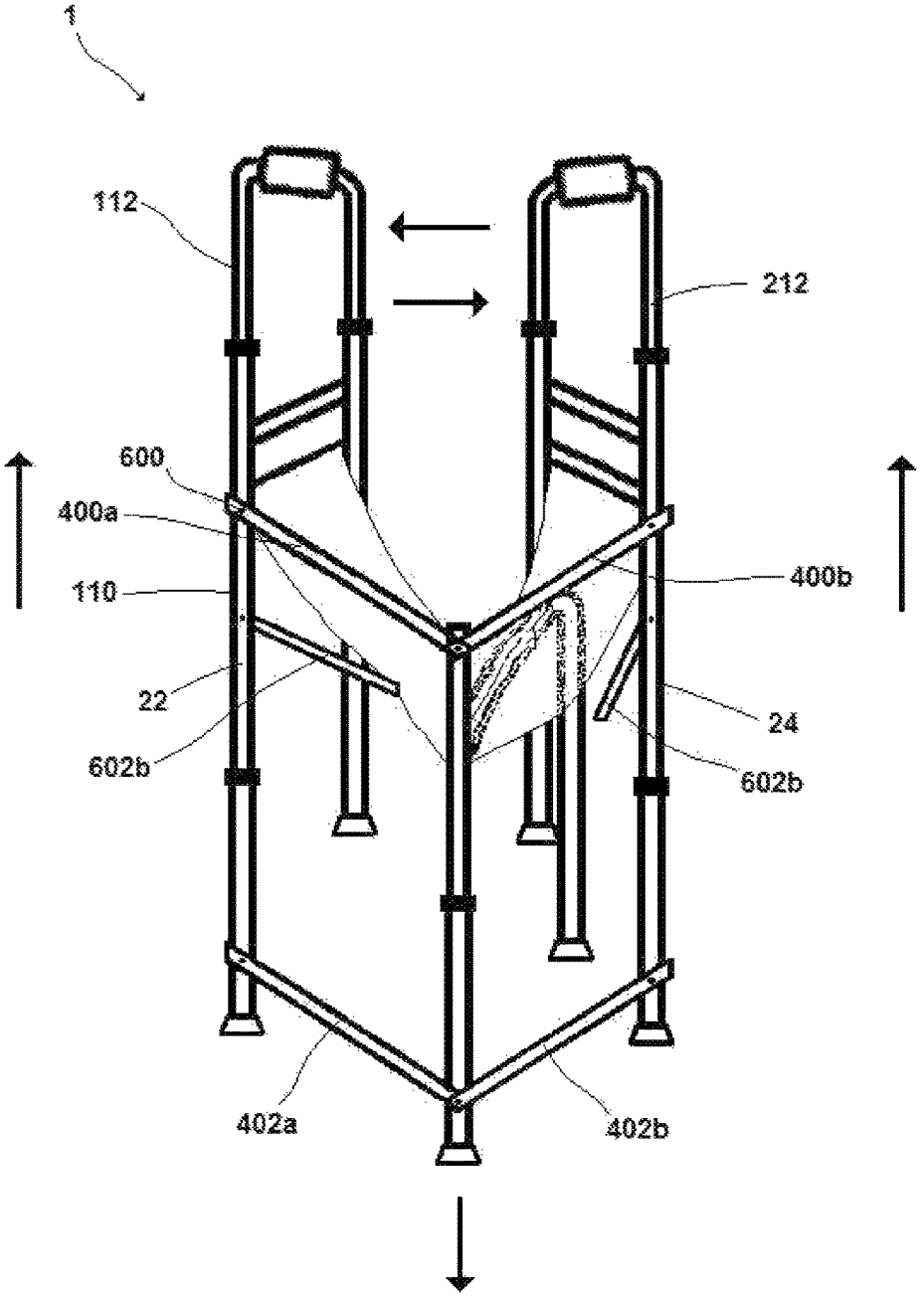
FIG. 6C is a front perspective view of another embodiment of the device which is shown in the process of being folded.

In yet another variant, the integration support member 400 may consist of two separate components, with a first component 400*a* attaching the first lateral support member 100 to the central support member 300 and a second component 400*b* attaching the second lateral support member 200 to the central support member 300. As in the previously described variant, each of the pivot members 600 may be a pivot pin. One pivot pin passes through one end of the first component 400*a* of the integration support member 400 and the central support member 300, while another pivot pin passes through the other end of the first component 400*a* of the integration support member 400 and the first lateral support member 100. Another pivot pin passes through one end of the second component 400*b* of the integration support member 400 and the central support member 300, while another pivot pin passes through the other end of the second component 400*b* of the integration support member 400 and the second lateral support member 200. The locking member 602*b* may be a pair of removable cross members, one of which attaches at one end to the first component 400*a* of the integration support member 400 and at the other end to the first lateral support member 100, and the other cross member 602*b* attaches at one end to the second component 400*b* of the integration support member 400 and at the other end to the second lateral support member 200. Where a supplemental integration support member 402 is used, it is configured the same as the integration support member 400, with a first component 402*a* and a second component 402*b*, with pivot pins passing through the components of the frame 10 in the same manner. In order to fold the device 1, at least one end of each of the locking members 602*b* is detached; then, the first and second lateral support members 100,200 are moved vertically with regard to the central support member 300. The integration support member 400 pivots about the pivot pins such that its first and second components 400*a*,400*b* form a "V", bringing the first and second lateral support members 100,200 together. That is, movement of the central support member 300 downward relative to the first and second lateral support members 100,200 results in the first and second lateral support members 100,200 being brought closer together. See FIG. 6*c*.

Accessories or optional features may be used with the embodiments of the frame 10 having legs, as described above. For example, the feet 150,160,250,260,350,360 may have attached to them large, flat pads, providing a larger surface area so that the device 1 is less likely to sink into the ground 5 while gardening. The pads may be removably attached or permanently attached. The feet 150,160,250,260, 350,360 may have attached to them casters, wheels, or other rolling devices, allowing the device 1 to be easily rolled across a smooth surface during use, for example, by a user hand washing a floor. The rolling devices may be removably attached or permanently attached. Other accessories or optional features are also contemplated.

In another embodiment of the kneeler 1, the first lateral support member 100 of the frame 10 is substantially planar. It is oriented substantially vertically and is substantially perpendicular to the supporting surface 5 onto which the kneeler 1 is placed when in use. Similarly, the second lateral support member 200 of the frame 10 is substantially planar. It is oriented substantially vertically and is substantially perpendicular to the supporting surface 5 and substantially parallel to the first lateral support member 100. The second lateral support member 200 may be dimensioned and sized substantially the same as the first lateral support member 100. In the same manner, the central support member 300 of the frame 10 is substantially planar. It is oriented substantially vertically and perpendicular to the supporting surface 5 and substantially parallel to the first lateral support member 100 and the second lateral support member 200. The central support member 300 has a height that is lower than the heights of the first lateral support member 100 and the second lateral support member 200. Finally, the integration support member 400 is substantially planar and is oriented substantially vertically and perpendicular to the supporting surface 5 and perpendicular to the first lateral support member 100, the second lateral support member 200, and the central support member 300. See FIGS. 5A through 5D. Each of the first lateral support member 100, the second lateral support member 200, the central support member 300, and the integration support member 400 may be made of wood, plastic, metal, or a composite material. All of the components may be made of the same material, or different materials may be used for different components. Each planar component may be continuous, like a board, or created of a latticed structure, like a milk crate, or with apertures or other elements formed therethrough, for the purpose of saving weight.

In this embodiment, both of the first lateral support member 100 and the second lateral support member 200 have an upper portion, a middle portion, and a lower portion. The central support member 300 has an upper portion and a lower portion. The first knee support pouch 22 attaches to the first lateral support member 100 at the middle portion of the first lateral support member 100 and attaches to the central support member 300 at the upper portion of the central support member 300. The second knee support pouch 24 attaches to the second lateral support member 200 at the middle portion of the second lateral support member 200 and attaches to the central support member 300 at the upper portion of the central support member 300. The integration support member 400 attaches to the lower portion of the first lateral support member 100, to the lower portion of the second lateral support member 200, and to the lower portion of the central support member 300. See FIGS. 5A through 5D.

In a variant of this embodiment, the frame 10 may further comprise a base panel 500. The base panel 500 is substantially planar and oriented substantially horizontally. It is configured to being placed onto the surface 5. The base panel 500 is attached to the lower portion of the first lateral support member 100, to the lower portion of the second lateral support member 200, and to the lower portion of the central support member 300. The base panel 500 provides additional structural rigidity to the frame 10. It also allows the kneeler 1 to be used as a seat when inverted, whereby the base panel 500 is oriented upwards. See FIG. 5D. When the kneeler 1 is to be used as a seat, the first lateral support member 100 and the second lateral support member 200 must be of substantially the same height, the top edge 108 of the first lateral support member 100 is oriented substantially horizontally, and the top edge 208 of the second lateral support member 200 is oriented substantially horizontally. The base panel 500 may be made of wood, plastic, metal, or a composite material. It may be made of the same material as the other components of the frame 10, or of a different material than one or more of the other components. Similarly, the base panel 500 may be continuous, like a board, or created of a latticed structure, like a milk crate, or with apertures or other elements formed therethrough, for the purpose of saving weight.

In another variant of this embodiment, the kneeler 1 has a first handle 32 formed into the upper portion of the first lateral support member 100 of the frame 10, and has a second handle formed into the upper portion of the second lateral support member 200 of the frame 10. See FIGS. 5A through 5D. In yet another variant of this embodiment, the first handle 32 is simply the upper portion of the first lateral support member 100 of the frame 10, and the second handle is the upper portion of the second lateral support member 200 of the frame 10. In yet another variant of this embodiment, the first handle 32 is attached to the top edge 108 of the first lateral support member 100, and the second handle 34 is attached to the top edge 208 of the second lateral support member 200. In this variant the first and second handles 32, 34 may be made of a cushioning material, such as closed cell foam, or from plastic or other material.

In one embodiment of the present invention, the first knee support pouch 22 is made of a durable, flexible material. The first knee support pouch 22 is suspended downward from its point of attachment to the first lateral support member 100 of the frame 10 and from its point of attachment to the central support member 300 of the frame 10. The first knee support pouch 22 is further contoured to accommodate a human knee 2. Likewise, the second knee support pouch 24 is made of a durable, flexible material. The second knee support pouch 24 is suspended downward from its point of attachment to the second lateral support member 200 of the frame 10 and from its point of attachment to the central support member 300 of the frame 10. The second knee support pouch 24 is further contoured to accommodate a human knee 2.

Figure 3A:
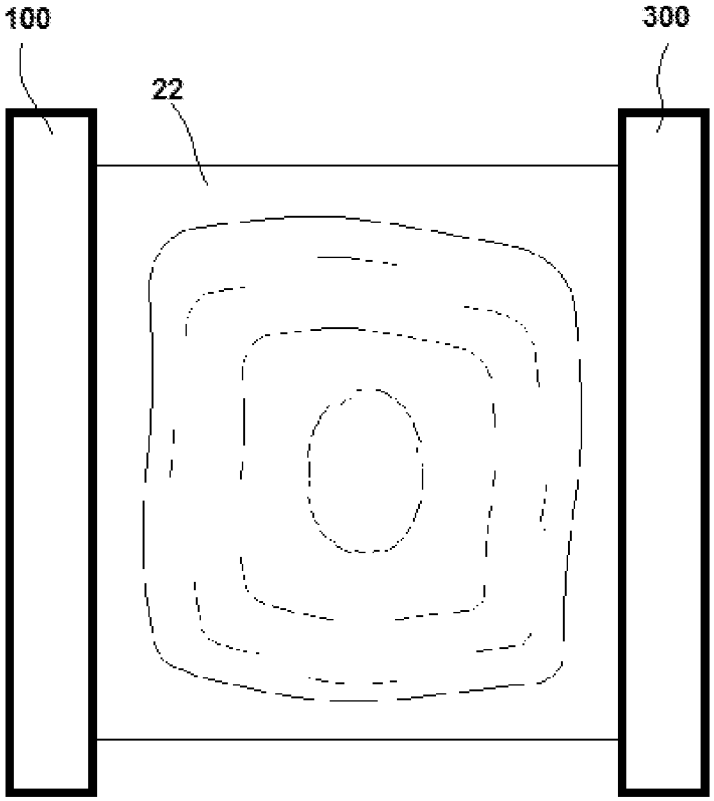
FIG. 3A is a top plan view of one embodiment of the first knee support pouch, wherein the first knee support pouch is made entirely of an elastomeric material.

In a variant of this embodiment, the first knee support pouch 22 and the second knee support pouch 24 are at least partially made from an elasticized material. This material may be natural rubber, synthetic rubber, Spandex™, or any other elastomeric material. In this variant, the first knee support pouch 22 and the second nee support pouch 24 are directly attached to the frame 10. See FIG. 3A.

Figure 3B:
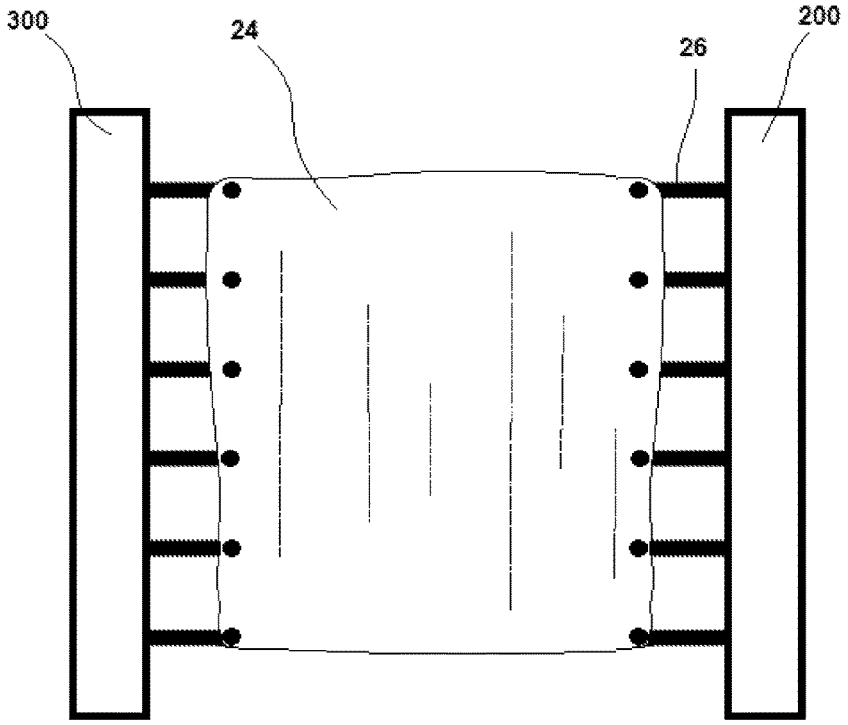
FIG. 3B is a top plan view of an alternative embodiment of the second knee support pouch, wherein the second knee support pouch is made of a flexible material and is attached to the frame of the device by a plurality of elasticized support members.

In another variant of this embodiment, the first knee support pouch 22 and the second knee support pouch 200 are made from a non-elasticized material. This material may be canvas, leather, plastic, or any type of non-stretchy cloth. In this variant, the first knee support pouch 22 is attached to the first lateral support member 100 of the frame 10 by one or more elasticized support members 26 and is attached to the central support member 300 of the frame 10 by one or more elasticized support members 26. The second knee support pouch 24 is similarly attached to the second lateral support member 200 of the frame 10 by one or more elasticized support members 26 and is attached to the central support member 300 of the frame 10 by one or more elasticized support members 26. See FIGS. 3B and 5B. The elasticized support members 26 may be made of natural rubber, synthetic rubber, or any other elastomeric material. In a preferred embodiment, the elasticized support members 26 are short bungee cords.

In yet another variant of this embodiment, the first knee support pouch 22 and the second knee support pouch 24 are at least partially made from an elasticized material, as described above, the first knee support pouch 22 is attached to the first lateral support member 100 of the frame 10 by one or more elasticized support members 26 and is attached to the central support member 300 of the frame 10 by one or more elasticized support members 26, and the second knee support pouch 24 is attached to the second lateral support member 200 of the frame 10 by one or more elasticized support members 26 and is attached to the central support member 300 of the frame 10 by one or more elasticized support members 26, as described above.

In yet another variant of this embodiment, the first knee support pouch 22 and the second knee support pouch 24 are formed from a unitary knee support member. The unitary knee support member is made from an elasticized material, as described above. One end of the unitary knee support member is attached to the first lateral support member 100 of the frame 10, the other end of the unitary knee support member is attached to the second lateral support member 220 of the frame 10, and a midpoint portion of the unitary knee support member is attached to the central support member 300 of the frame. See FIG. 1. The portion of the unitary knee support member located between the first lateral support member 100 and the central support member 300 becomes the first knee support pouch 22, and the portion of the unitary knee support member located between the second lateral support member 200 and the central support member 300 becomes the second knee support pouch 24. The unitary knee support member may be directly attached to the first and second lateral support members 100,200, or it may be attached to the first and second lateral support members 100,200 by a plurality of elasticized support members 26, as described above.

Modifications and variations can be made to the disclosed embodiments of the device of the present invention without departing from the subject or spirit of the invention as defined in the following claims.

I claim:

1. A kneeler comprising a frame, a first knee support pouch, and a second knee support pouch;

said frame having a first lateral support member, a second lateral support member, a central support member, and an integration support member, with each of the first lateral support member, the second lateral support member, the central support member, and the integration support member being rigid, and the first lateral support member being spaced apart from the second lateral support member, the central support member being spaced apart from the first lateral support member and from the second lateral support member and located between the first lateral support member and the second lateral support member, and the integration support member being attached to the first lateral support member, the second lateral support member, and the central support member;

said first knee support pouch being located between and attached to the first lateral support member of the frame and the central support member of the frame, said first knee support pouch being made of a durable, flexible material, said first knee support pouch being suspended downward from a point of attachment to the first lateral support member of the frame and from a point of attachment to the central support member of the frame, and said first knee support pouch being contoured to accommodate a human knee; and said second knee support pouch being located between and attached to the second lateral support member of the frame and the central support member of the frame, said second knee support pouch being made of a durable, flexible material, said second knee support pouch being suspended downward from a point of attachment to the second lateral support member of the frame and from a point of attachment to the central support member of the frame, and said second knee support pouch being contoured to accommodate a human knee.

2. The kneeler of claim 1 wherein the first knee support pouch is at least partially comprised of an elasticized material; and the second knee support pouch is at least partially comprised of an elasticized material.

3. The kneeler of claim 2 wherein the first knee support pouch is suspended downward from the point of attachment of the first knee support pouch to the first lateral support member of the frame by one or more elasticized support members;

the first knee support pouch is suspended downward from the point of attachment of the first knee support pouch to the central support member of the frame by one or more elasticized support members;

the second knee support pouch is suspended downward from the point of attachment of the second knee support pouch to the second lateral support member of the frame by one or more elasticized support members; and the second knee support pouch is suspended downward from the point of attachment of the second knee support pouch to the central support member of the frame by one or more elasticized support members.

4. The kneeler of claim 1 wherein the first knee support pouch is suspended downward from the point of attachment of the first knee support pouch to the first lateral support member of the frame by one or more elasticized support members;

the first knee support pouch is suspended downward from the point of attachment of the first knee support pouch to the central support member of the frame by one or more elasticized support members;

the second knee support pouch is suspended downward from the point of attachment of the second knee support pouch to the second lateral support member of the frame by one or more elasticized support members; and the second knee support pouch is suspended downward from the point of attachment of the second knee support pouch to the central support member of the frame by one or more elasticized support members.

5. The kneeler of claim 1 wherein the first lateral support member of the frame is substantially planar and is oriented substantially vertically and perpendicular to a supporting surface onto which the kneeler is placed when in use, with the first lateral support member of the frame having an upper portion, a middle portion, and a lower portion, with the point of attachment of the first knee support pouch to the first lateral support member of the frame being located on the middle portion of the first lateral support member of the frame;

the second lateral support member of the frame is substantially planar and is oriented substantially vertically and perpendicular to the supporting surface and parallel to the first lateral support member of the frame, with the second lateral support member of the frame having an upper portion, a middle portion, and a lower portion, with the point of attachment of the second knee support pouch to the second lateral support member of the frame being located on the middle portion of the second lateral support member of the frame;

the central support member of the frame is substantially planar and is oriented substantially vertically and perpendicular to the supporting surface and substantially parallel to the first lateral support member of the frame and substantially parallel to the second lateral support member of the frame, with the central support member of the frame having an upper portion and a lower portion, with the point of attachment of the first knee support pouch to the central support member of the frame being located on the upper portion of the central support member of the frame and the point of attachment of the second knee support pouch to the central support member of the frame being located on the upper portion of the central support member of the frame; and the integration support member of the frame is substantially planar and is oriented substantially vertically and perpendicular to the supporting surface and perpendicular to the first lateral support member of the frame and perpendicular to the second lateral support member of the frame and perpendicular to the central support member of the frame, with the integration support member of the frame being attached to the lower portion of the first lateral support member of the frame and to the lower portion of the second lateral support member of the frame and to the lower portion of the central support member of the frame.

6. The kneeler of claim 5 wherein the frame further comprises a base panel, with said base panel being substantially planar and oriented substantially horizontally, said base panel configured to being placed onto the supporting surface, with said base panel being attached to the lower portion of the first lateral support member of the frame and to the lower portion of the second lateral support member of the frame and to the lower portion of the central support member of the frame.

7. The kneeler of claim 5 wherein each of the first lateral support member of the frame, the second lateral support member of the frame, the central support member of the frame, and the integration support member of the frame is at least partially made of one of the following group of materials: wood, plastic, and metal.

8. The kneeler of claim 6 wherein each of the first lateral support member of the frame, the second lateral support member of the frame, the central support member of the frame, the integration support member of the frame, and the base panel of the frame is at least partially made of one of the following group of materials: wood, plastic, and metal.

9. The kneeler of claim 1 wherein the first lateral support member of the frame is formed of a tubular member shaped into an inverted U, having a substantially vertically oriented front leg, a substantially vertically oriented rear leg, a substantially horizontally oriented top portion connecting the front leg to the rear leg, a substantially horizontally oriented cross member connecting the front leg to the rear leg and located below the top portion, a front foot located at an end of the front leg opposite the top portion, and a rear foot located at an end of the rear leg opposite the top portion, with the first lateral support member of the frame oriented substantially vertically and perpendicular to a supporting surface onto which the kneeler is placed when in use, and with the point of attachment of the first knee support pouch to the first lateral support member of the frame being located on the cross member of the first lateral support member of the frame;

the second lateral support member of the frame is formed of a tubular member shaped into an inverted U, having a substantially vertically oriented front leg, a substantially vertically oriented rear leg, a substantially horizontally oriented top portion connecting the front leg to the rear leg, a substantially horizontally oriented cross member connecting the front leg to the rear leg and located below the top portion, a front foot located at an end of the front leg opposite the top portion, and a rear foot located at an end of the rear leg opposite the top portion, with the second lateral support member of the frame oriented substantially vertically and perpendicular to the supporting surface and substantially parallel to the first lateral support member of the frame, and with the point of attachment of the second knee support pouch to the second lateral support member of the frame being located on the cross member of the second lateral support member of the frame;

the central support member of the frame is formed of a tubular member shaped into an inverted U, having a substantially vertically oriented front leg, a substantially vertically oriented rear leg, a substantially horizontally oriented top portion connecting the front leg to the rear leg, a front foot located at an end of the front leg opposite the top portion, and a rear foot located at an end of the rear leg opposite the top portion, with the central support member of the frame oriented substantially vertically and perpendicular to the supporting surface and substantially parallel to the first lateral support member of the frame and substantially parallel to the second lateral support member of the frame, with the point of attachment of the first knee support pouch to the central support member of the frame being located on the top portion of the central support member of the frame, and the point of attachment of the second knee support pouch to the central support member of the frame being located on the top portion of the central support member of the frame;

the integration support member of the frame is formed of an elongate member and is oriented substantially horizontally and attached to the front leg of the first lateral support member of the frame and to the front leg of the second lateral support member of the frame and to the front leg of the central support member of the frame.

10. The kneeler of claim 9 wherein the integration support member of the frame is formed of a tubular member.

11. The kneeler of claim 9 wherein the integration support member of the frame is formed of a flat bar.

12. The kneeler of claim 9 wherein the first lateral support member of the frame further comprises one or more supplementary cross members, with each said supplementary cross member formed of a tubular member and oriented substantially horizontally and connecting the front leg of the first lateral support member of the frame to the rear leg of the first lateral support member of the frame, and the second lateral support member of the frame further comprises one or more supplementary cross members, with each said supplementary cross member formed of a tubular member and oriented substantially horizontally and connecting the front leg of the second lateral support member of the frame to the rear leg of the second lateral support member of the frame.

13. The kneeler of claim 9 wherein the frame further comprises one or more supplementary integration support members, with each said supplementary integration support member formed of an elongate member and oriented substantially horizontally and attached to the front leg of the first lateral support member of the frame and to the front leg of the second lateral support member of the frame.

14. The kneeler of claim 13 wherein each supplementary integration support member of the frame is formed of a tubular member.

15. The kneeler of claim 13 wherein each supplementary integration support member of the frame is formed of a flat bar.

16. The kneeler of claim 9 wherein the central support member further comprises an extension member, said extension member extending upwardly from the front leg of the central support member of the frame; and the frame further comprises one or more supplementary integration support members, with each said supplementary integration support member formed of a tubular member and oriented substantially horizontally and attached to the front leg of the first lateral support member of the frame and to the front leg of the second lateral support member of the frame, and at least one of said one or more supplementary integration support members is attached to the extension member of the central support member of the frame.

17. The kneeler of claim 9 wherein the front leg of the first lateral support member of the frame has a telescoping lower portion which is configured to allow said front leg of the first lateral support member of the frame to be lengthened or shortened;

the rear leg of the first lateral support member of the frame has a telescoping lower portion which is configured to allow said rear leg of the first lateral support member of the frame to be lengthened or shortened;

the front leg of the second lateral support member of the frame has a telescoping lower portion which is configured to allow said front leg of the second lateral support member of the frame to be lengthened or shortened;

the rear leg of the second lateral support member of the frame has a telescoping lower portion which is configured to allow said rear leg of the second lateral support member of the frame to be lengthened or shortened;

the front leg of the central support member of the frame has a telescoping lower portion which is configured to allow said front leg of the central support member of the frame to be lengthened or shortened; and the rear leg of the central support member of the frame has a telescoping lower portion which is configured to allow said rear leg of the central support member of the frame to be lengthened or shortened.

18. The kneeler of claim 9 wherein the front leg of the first lateral support member of the frame has a telescoping upper portion which is configured to allow said front leg of the first lateral support member of the frame to be lengthened or shortened;

the rear leg of the first lateral support member of the frame has a telescoping upper portion which is configured to allow said rear leg of the first lateral support member of the frame to be lengthened or shortened;

the front leg of the second lateral support member of the frame has a telescoping upper portion which is configured to allow said front leg of the second lateral support member of the frame to be lengthened or shortened; and the rear leg of the second lateral support member of the frame has a telescoping upper portion which is configured to allow said rear leg of the second lateral support member of the frame to be lengthened or shortened.

19. The kneeler of claim 9 wherein the front leg of the central support member of the frame has a telescoping upper portion which is configured to allow said front leg of the central support member of the frame to be lengthened or shortened; and the rear leg of the central support member of the frame has a telescoping upper portion which is configured to allow said rear leg of the central support member of the frame to be lengthened or shortened.

20. The kneeler of claim 9 wherein the frame further comprises a plurality of pivot members connecting the first lateral support member to the integration support member, the second lateral support member to the integration support member, and the central support member to the integration support member, whereby by use of said pivot members the frame is capable of being folded.

21. The kneeler of claim 20 wherein the frame further comprises a plurality of locking mechanisms, with each said locking mechanism associated with one of the plurality of pivot members, with each said locking mechanism configured to have a locked state and an unlocked state, whereby when said locking mechanism is in the locked state the pivot member associated therewith is prevented from moving, and when said locking mechanism is in the unlocked state the pivot member associated therewith is free to move.

22. The kneeler of claim 20 wherein each said pivot member is a hinge.

23. The kneeler of claim 20 wherein each said pivot member is a pivot pin; and the frame further comprises a locking mechanism, with said locking mechanism configured to have a locked state and an unlocked state, whereby when said locking mechanism is in the locked state the integration support member is prevented from moving relative to the first lateral support member and the second lateral support member, and when said locking mechanism is in the unlocked state the integration support member is free to move relative to the first lateral support member and the second lateral support member.

24. The kneeler of claim 23 wherein the locking mechanism comprises a first cross member configured to be removably attached to the integration support member and the first lateral support member; and a second cross member configured to be removably attached to the integration support member and the second lateral support member;

whereby the locking mechanism is in the locked state when the first cross member of the locking mechanism is attached to both the integration support member and the first lateral support member, and the second cross member of the locking mechanism is attached to both the integration support member and the second lateral support member;

and the locking mechanism is in the unlocked state when the first cross member of the locking mechanism is detached from at least one of the integration support member and the first lateral support member, and the second cross member of the locking mechanism is detached from at least one of the integration support member and the second lateral support member.

25. The kneeler of claim 2 wherein the first knee support pouch and the second knee support pouch are formed from a unitary knee support member.

26. The kneeler of claim 6 wherein the first lateral support member of the frame has a height and a top edge, said top edge being located at the upper portion of the first lateral support member of the frame and oriented substantially horizontally; and the second lateral support member of the frame has a height and a top edge, said height of the second lateral support member being substantially the same as the height of the first lateral support member, and said top edge being located at the upper portion of the second lateral support member of the frame and oriented substantially horizontally;

wherein the kneeler may be inverted such that the top edge of the first lateral support member and the top edge of the second lateral support member are both placed onto the supporting surface and the base panel may be used as a seating surface.

27. The kneeler of claim 1 further comprising a first handle and a second handle;

wherein said first handle is located on the first lateral support member of the frame and said second handle is located on the second lateral support member of the frame.

28. The kneeler of claim 5 further comprising a first handle and a second handle;

wherein said first handle is formed into the upper portion of the first lateral support member of the frame and said second handle is formed into the upper portion of the second lateral support member of the frame.

29. The kneeler of claim 9 further comprising a first handle and a second handle;

wherein said first handle is located on the top portion of the first lateral support member of the frame and said second handle is located on the top portion of the second lateral support member of the frame.

* * * * *